US009704301B2

(12) United States Patent
Barrett et al.

(10) Patent No.: US 9,704,301 B2
(45) Date of Patent: Jul. 11, 2017

(54) PRINTED POSTAGE CONTAINER HAVING INTEGRATED SECURITY FEATURES

(75) Inventors: Daniel J. Barrett, Washington, DC (US); Daniel Y. Chen, Springfield, VA (US); Robert W. Lee, Port Republic, MD (US)

(73) Assignee: United States Postal Service, Washington, DC (US)

( * ) Notice: Subject to any disclaimer, the term of this patent is extended or adjusted under 35 U.S.C. 154(b) by 1681 days.

(21) Appl. No.: 11/207,473

(22) Filed: Aug. 18, 2005

(65) Prior Publication Data

US 2006/0155658 A1 Jul. 13, 2006

Related U.S. Application Data

(60) Provisional application No. 60/602,627, filed on Aug. 19, 2004.

(51) Int. Cl.
*G07B 17/00* (2006.01)
*B65D 27/00* (2006.01)

(52) U.S. Cl.
CPC ..... *G07B 17/00508* (2013.01); *B65D 27/00* (2013.01); *B65D 2101/00* (2013.01); *G07B 2017/0058* (2013.01); *G07B 2017/00637* (2013.01)

(58) Field of Classification Search
CPC ..... G07B 17/00508
USPC ..... 705/401, 408
See application file for complete search history.

(56) References Cited

U.S. PATENT DOCUMENTS

| | | | | |
|---|---|---|---|---|
| 5,395,138 | A * | 3/1995 | Chang | 283/95 |
| 5,468,581 | A * | 11/1995 | Coe et al. | 430/22 |
| 5,554,842 | A * | 9/1996 | Connell et al. | 235/491 |
| 5,912,682 | A * | 6/1999 | Parkos | 347/40 |
| 6,000,728 | A * | 12/1999 | Mowry, Jr. | 283/93 |
| 6,373,965 | B1 * | 4/2002 | Liang | 382/112 |
| 6,524,846 | B1 * | 2/2003 | Robinson, Jr. | 435/287.4 |
| 6,692,030 | B1 * | 2/2004 | Phillips | 283/91 |
| 2002/0054680 | A1 * | 5/2002 | Huang et al. | 380/54 |
| 2003/0005303 | A1 * | 1/2003 | Auslander et al. | 713/176 |
| 2003/0080182 | A1 * | 5/2003 | Gunther | 235/375 |
| 2003/0105730 | A1 * | 6/2003 | Rhoads et al. | 705/407 |
| 2003/0130954 | A1 * | 7/2003 | Carr et al. | 705/60 |
| 2003/0140015 | A1 * | 7/2003 | Applebaum | 705/406 |
| 2004/0066273 | A1 * | 4/2004 | Cortina et al. | 340/5.1 |
| 2005/0053234 | A1 * | 3/2005 | Alasia et al. | 380/54 |
| 2005/0154677 | A1 * | 7/2005 | Giori | 705/50 |
| 2006/0157559 | A1 * | 7/2006 | Levy et al. | 235/380 |
| 2008/0192992 | A1 * | 8/2008 | Moshe | 382/124 |

OTHER PUBLICATIONS

USPS Store (available at http://web.archive.org/web/20021113073604/shop.usps.com/cgi-bin/vsbv/postal_store_non_ssl/display_products/productDetail.jsp?BV_UseBVCookie=yes&appName=SSOL&OID=1003543, accessed Nov. 13, 2002).*

(Continued)

*Primary Examiner* — Nathan Erb
(74) *Attorney, Agent, or Firm* — Finnegan, Henderson, Farabow, Garrett & Dunner, LLP

(57) ABSTRACT

A container having postage printed on the container and having integrated authenticating security features is provided. The container can further include a recipient address field and a sender address field.

22 Claims, 4 Drawing Sheets

(56) References Cited

OTHER PUBLICATIONS

Roeben, Scott; "Ferreting Out Funny Money: Fighting Counterfeiting"; Dribbleglass.com; retrieved Apr. 11, 2003, Available at: https://web.archive.org/web/20030411143853/http://www.dribbleglass.com/subpages/counterfeit.htm.*
International Search Report dated Dec. 28, 2006 for Application No. PCT/US05/29279.
Written Opinion of the International Searching Authority dated Dec. 28, 2006 for Application No. PCT/US05/29279.

* cited by examiner

PRINTED POSTAGE CONTAINER HAVING INTEGRATED SECURITY FEATURES

CROSS-REFERENCE TO RELATED APPLICATION

Under provisions of 35 U.S.C. §119(e), this Application claims the benefit of U.S. Provisional Application No. 60/602,627, filed Aug. 19, 2004, which is incorporated herein in its entirety by reference.

FIELD OF THE INVENTION

The invention relates to a printed postage container, and more particularly, to a printed postage container having integrated security features for transporting an article for delivery.

BACKGROUND OF THE INVENTION

With the advent and steady growth of electronic commerce, the physical mail stream will increasingly be utilized for sending and receiving packages and other deliverable articles or items. Accordingly, there continues to be a need for a convenient, reliable, and efficient mechanism for consumers and businesses alike to transport these articles using conventional delivery systems.

In order for an article to travel through the mail delivery system, a consumer must purchase and attach postage to a container for transporting that article. In many instances, this involves a consumer traveling to a postage dispensing facility to procure the appropriate amount of postage, based on factors such as the container's weight, size, destination, and desired delivery time. The postage paid is traditionally indicated on a label or stamp that is attached to the container through the use of an adhesive. In some cases, the consumer applies moisture to the back of the postage, in order to attach the postage to the container. In conventional systems, postage may become dislodged by machinery, by the handling of deliverers, or temperature variations that can affect the adhesive used on the postage label or stamp.

Therefore, it would be desirable to provide a container that avoids the potential problem of having attached postage become dislodged during the container's travel through a mail delivery system. It is also desirable to provide a container that would allow the user to avoid having to separately travel to a postage dispensing facility to procure the required postage for delivery. In addition, it would be desirable to provide such a container having integrated security features to ensure that counterfeiting or forgery of the container or postage has not occurred.

SUMMARY OF THE INVENTION

In accordance with the invention, a container for preventing dislodgement of postage and providing authenticating security features to prevent counterfeiting and/or forgery as discussed hereinabove is provided.

In one aspect, the container comprises postage printed on the secure item container, a security element for authenticating the container, and a recipient address field. The security element can include, for example, a pseudo-latent image, an encoded design, or a phosphorescent taggant.

In yet another aspect, the container comprises postage printed on the container, a security element for authenticating the container, a recipient address field, and a sender address field. The security element can include, for example, a pseudo-latent image, an encoded design, or a phosphorescent taggant.

Both the foregoing general description and the following detailed description are exemplary and are intended to provide further explanation of the invention as claimed.

DESCRIPTION OF THE EMBODIMENTS

Figure 1:
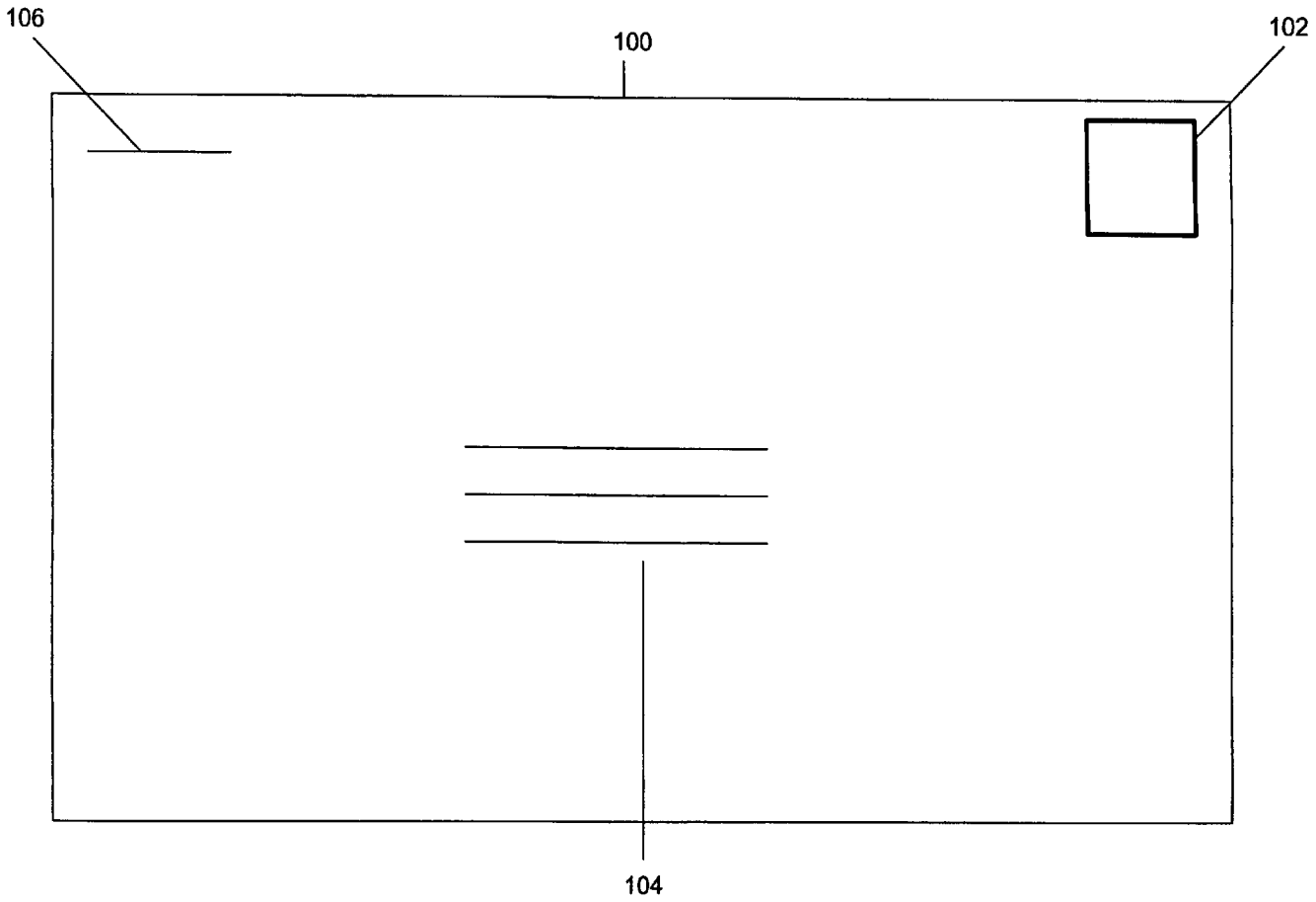
FIG. 1 (PRIOR ART)
FIG. 1 illustrates a conventional container of the prior art.

The following detailed description refers to the accompanying drawings. Wherever possible, the same reference numbers are used in the drawings and the following description to refer to the same or similar parts. While several exemplary embodiments and features of the invention are described herein, modifications, adaptations, and other implementation are possible without departing from the spirit and components illustrated in the drawings, and the exemplary methods described herein may be modified by substituting, reordering, or adding steps to the disclosed methods. Accordingly, the following detailed description does not limit the invention. Instead, the proper scope of the invention is defined by the appended claims.

FIG. 1 shows a conventional envelope 100 of the prior art that may be used for transporting an article through a conventional delivery system, such as for example, a mail delivery system like the United States Postal Service™. The envelope 100 can include a recipient address field 104 for displaying information concerning a recipient's address information. The envelope 100 may also include a sender address field 106 for displaying information concerning the sender's address information. Also included is a postage field 102 that may be used for holding the postage stamp or label applied to the envelope 100 by the sender. The stamp usually contains an adhesive backing and may become dislodged during its travels through the mail delivery system due to, for example, processing machinery, handling by deliverers, and/or temperature variations. The postage field 102 may also contain instead an ink stamp indicating the amount of postage paid. The ink stamp can be placed directly onto the postage field 102 or onto an adhesive label, which would be susceptible to dislodgment in the same manner described for the adhesive stamp. Although the ink stamp is not prone to dislodgement, it is, however, capable of becoming smeared and illegible due to exposure to moisture.

Figure 2:
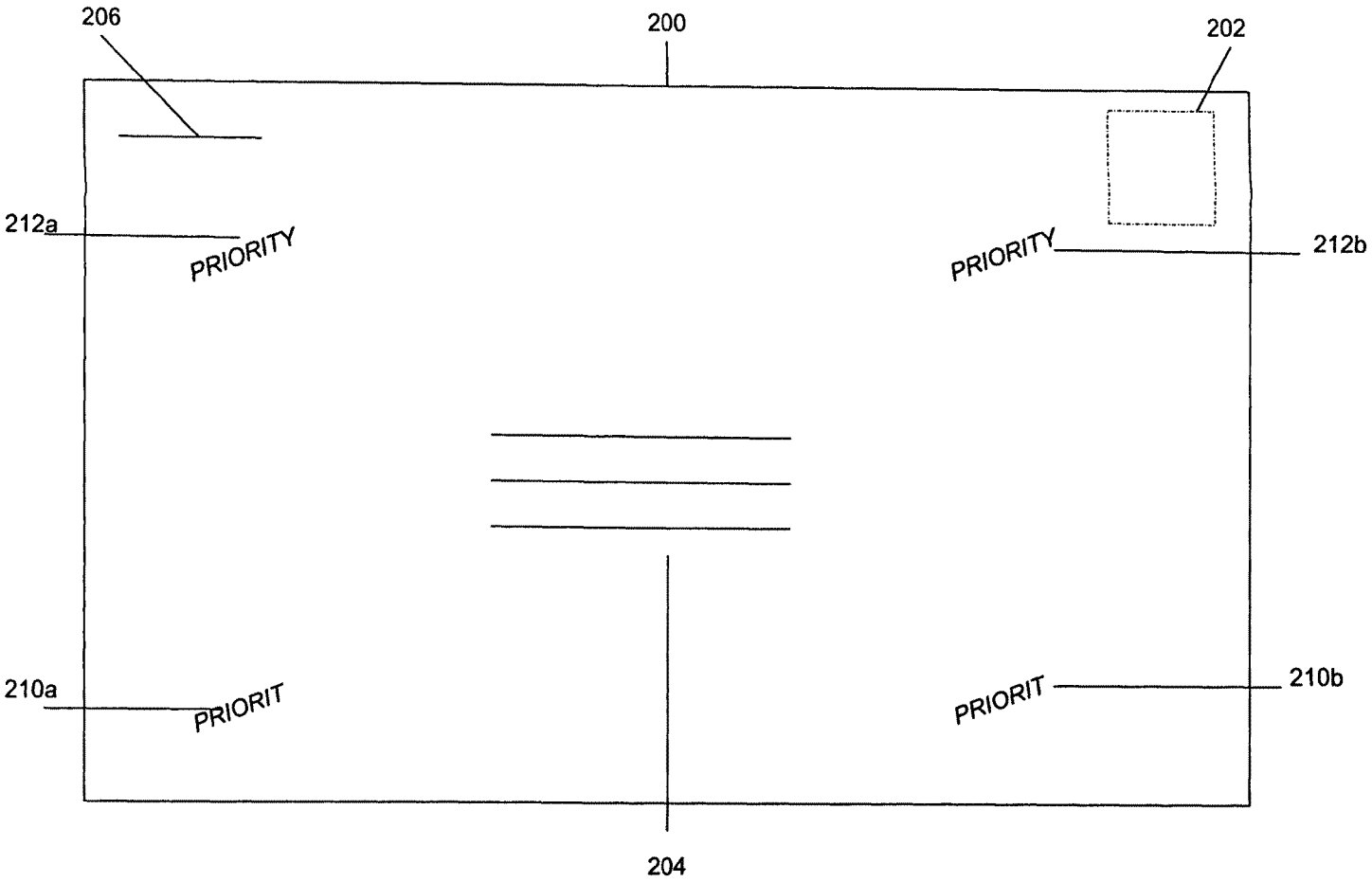
FIG. 2 illustrates an exemplary container consistent with an embodiment of the present invention.

FIG. 2 illustrates an exemplary container 200 consistent with an embodiment of the present invention. The container 200 can be constructed and sized for travel through a delivery system where an article or item is sent from one destination to another, such as for example, the mail delivery system of the U.S. Postal Service™ or the package delivery system of other commercial services. The container 200 may be used to transport items through an item delivery system such as those mentioned above. It is contemplated that the container 200 of the present invention can encompass any suitable shape or design for mailing the intended item for delivery, such for example, a closeable and/or sealable envelope, box, tube, or bag.

As shown in FIG. 2, in one exemplary embodiment a container 200 can include a recipient address field 204 for displaying information concerning the intended recipient's address. A recipient address field 204 can include information such as, for example, the street, state, city, county and/or ZIP Code™ of the recipient. In certain instances, the country of the recipient can also be included. The container 200 can also include a sender address field 206 for displaying information concerning the sender's address. The sender address field 206 can include information such as, for example, the street, state, city, county and/or ZIP Code™ of the sender. If desired, the country of the sender may also be displayed.

The container 200 of the exemplary embodiment can also include postage 202, which may be postage that has been printed onto the container 200 as shown in FIG. 2. The printed postage 202 may include indicia representing the postage rate for the delivery of the container 200 to the recipient's address as indicated at field 204. The indicia can be, for example, numerals representing the amount of the postage or a symbol representing the postage rate. By providing a container 200 having the postage 202 printed on the container 200 itself, the user can avoid the potential problems with adhesive stamps or ink stamps previously mentioned, such as dislodgment, smearing, and illegibility due to machinery, physical handling, temperature variations and/or moisture. Further, the user does not have the inconvenience of having an additional step of procuring and applying postage to that container 200. In certain instances, the container 200 may be a pre-paid container 200 such that a user must pay the amount of the printed postage prior to actually receiving the container 200 for use. In other instances, the container 200 may be provided to the user and the postage paid prior to sending the container 200 through a mail or package delivery system.

In addition to preventing delivery delays by eliminating the possibility of the dislodgement of postage, the container 200 of the present invention can also include integrated security features to prevent counterfeiting and forgery of the containers 200. For example, the printed postage 202 can be printed using a process that resists rubbing and fading of the printed image. The container 200 can also be designed with multi-level authenticating security features. For example, as shown in FIG. 2, the container can include pseudo-latent images 212*a*, 212*b*. These images 212*a*, 212*b* can be formed, for example, during a colorless varnish overcoating process with a drop-off pattern that results in different optical reflectivity for uncoated areas and coated areas. The images 212*a*, 212*b* may be revealed if the container is examined from a side-view angle. Pseudo-latent images would not appear on a copy made using a standard copying machine. Such a security feature would prevent reprographic counterfeits and forged containers either produced from commercial printing processes or electronic reproduction using conventional containers. It is contemplated that the pseudo-latent images 212*a*, 212*b* can comprise any variety of letters, words, symbols, images, or combinations thereof. For purposes of illustration only, the images 212*a*, 212*b* shown in FIG. 2 comprise the word "PRIORITY."

In addition to pseudo-latent images 212*a*, 212*b*, the container 200 may also include the use of encoded designs 210*a*, 210*b* in order to defeat higher level counterfeiters. These encoded designs 210*a*, 210*b* would provide some verification code allowing law enforcement to determine the ultimate genuineness of a product. Therefore, a few strategic locations on the container 200 may be selected where the associated pseudo-latent images can be altered. For example, as shown in FIG. 2, container 200 can include encoded designs 210*a*, 210*b* that are pseudo-latent images that do not contain the correct or full spelling of the word "PRIORITY." Therefore, a law enforcement official would be capable of identifying a counterfeit container based on its lack of correct encoded designs. It is understood, of course, that other images may be implemented for the encoded designs in keeping with the spirit of the present invention. For example, variations in font style or size may also be utilized in the encoded design.

Figure 3:
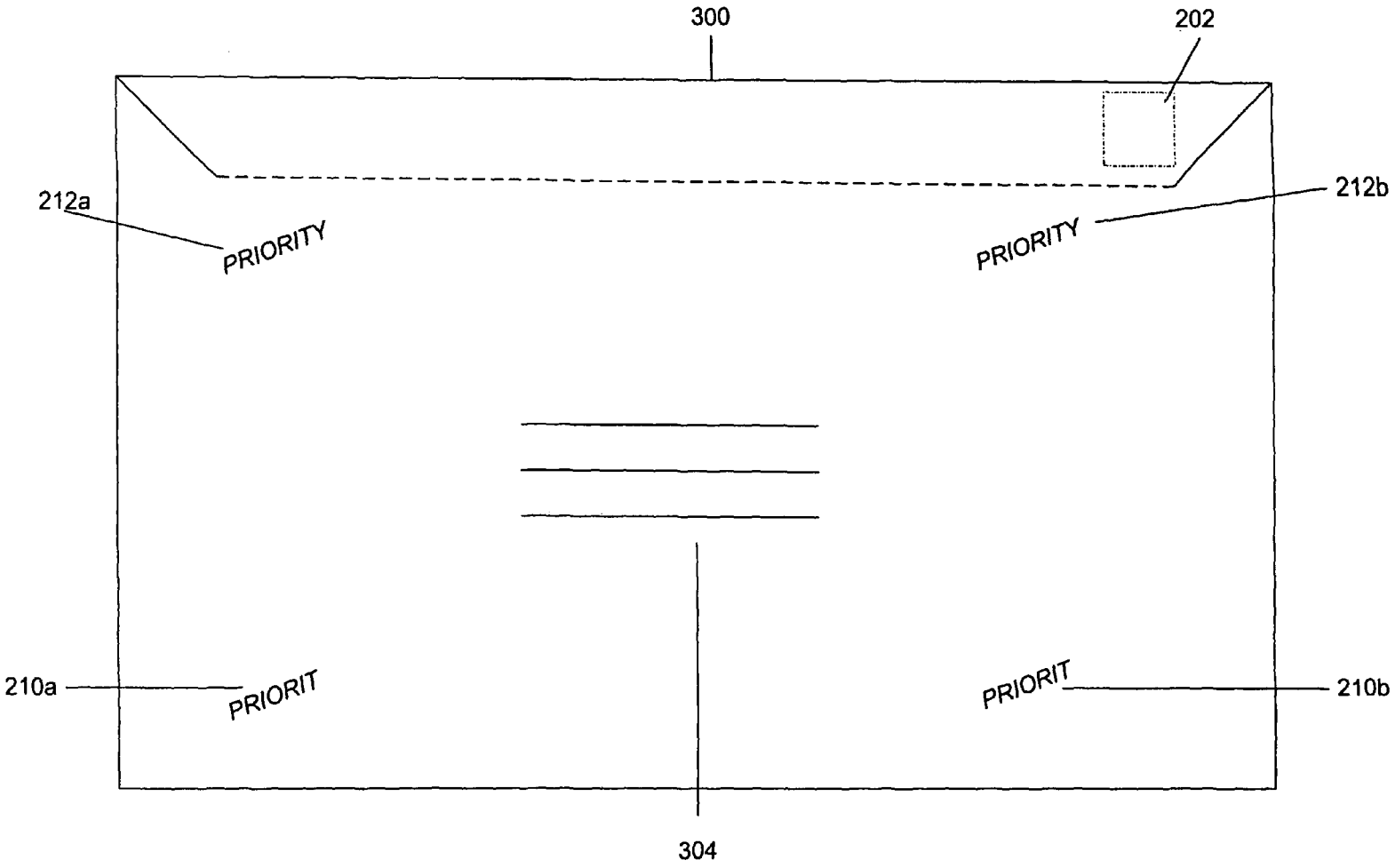
FIG. 3 illustrates another exemplary container consistent with an embodiment of the present invention.

The pseudo-latent images 212*a*, 212*b* and encoded designs 210*a*, 210*b* can be placed at any desired location on the container. FIG. 3 illustrates another exemplary embodiment of a container of the present invention in which the back of the container 300 may include pseudo-latent images 212*a*, 212*b* and encoded designs 210*a*, 210*b* similar to those shown in FIG. 2. Further, the back of container 300 may be used for storing recipient and/or sender address information. In the illustrated embodiment, the printed postage 202 can also be located on the back of the container 300. Turning now to the address field 304, the field 304 can include information such as the street, state, city, county, ZIP Code™, and/or country of the recipient. If desired the address field 304 may also contain information concerning the sender's address. This would include information such as the street, state, city, county, ZIP Code™, and/or country of the sender. This embodiment would allow a larger portion of the front of the container 300 to be used for storing an image which, if desired, may also be a pseudo-latent image or encoded design as previously described.

Figure 4:
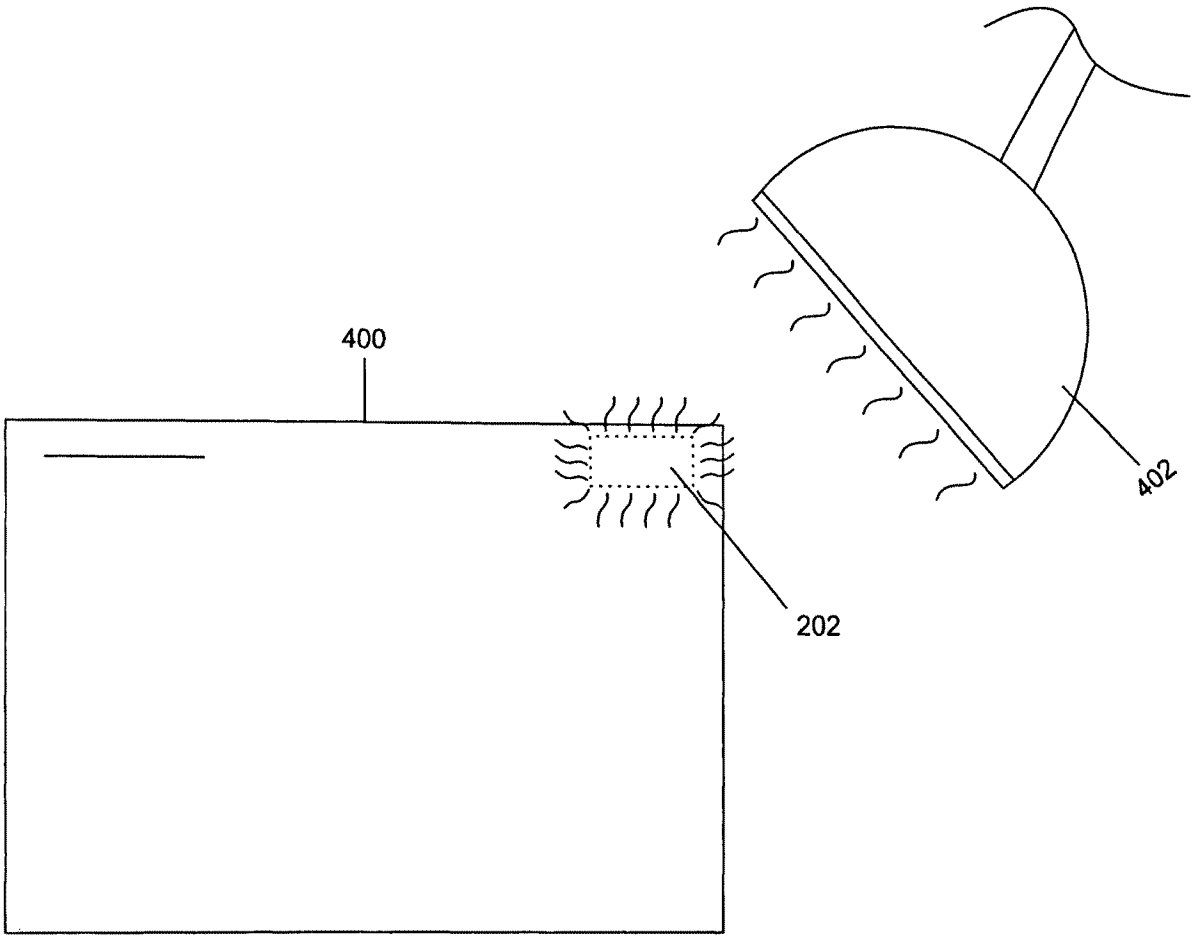
FIG. 4 illustrates yet another exemplary container consistent with an embodiment of the present invention.

FIG. 4 illustrates another exemplary embodiment of a container of the present invention. As shown, the container 400 can include a phosphorescent taggant that will emit light with a distinct wavelength when subjected to an ultraviolet light source 402. For example, the taggant may emit a specifically colored phosphorescence light only when viewed with a specific mail-processing detector, in order to provide an integrated security feature to prevent counterfeiting and/or forgery of the container 400. The phosphorescent taggant may be positioned at any desirable location on the container 400, such as for example, on the printed postage 202 as shown. However, it is contemplated that the phosphorescent taggant may be included at any location on the container 400.

The foregoing description has been limited to specific embodiments of this invention. It will be apparent, however, that various variations and modifications may be made to the invention, with the attainment of some or all of the advantages of the invention. It is the object of the appended claims to cover these and such other variations and modifications as come within the true spirit and scope of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A container, comprising:

pre-paid postage printed on the container prior to providing the container to a sender, the postage being visually perceivable by a human from all viewing angles with respect to a surface of the container; and a multi-level security element, comprising:

a pseudo-latent image comprising a plurality of letters forming a word, the pseudo-latent image formed on the surface of the container at a first location and being visually perceivable by a human from fewer than all viewing angles with respect to the surface of the container; and an encoded design comprising a version of the pseudo-latent image comprising a misspelling of the word, the misspelling of the word being according to a verification code indicating an authenticated misspelling of the word, and the encoded design formed on the surface of the container at a second location different from the first location and being visually perceivable by a human, wherein, based on the verification code, the visually perceivable encoded design is compared to the visually perceivable pseudo-latent image in order to authenticate the container.

2. The container of claim 1, wherein the pseudo-latent image comprises letters.

3. The container of claim 1, wherein the encoded design comprises letters.

4. The container of claim 1, comprising a phosphorescent taggant on the container.

5. The container of claim 4, wherein the phosphorescent taggant is located on the postage printed on the container.

6. The container of claim 1, wherein the postage printed on the container is rub resistant or fade resistant.

7. The container of claim 1, comprising a recipient address field, wherein the recipient address field comprises space for displaying a street address, a state, a city, a county, a delivery code, and a country of a recipient of the container.

8. The container of claim 1, further including a sender address field comprising space for displaying a street address, a state, a city, a county, a delivery code, and a country of the sender of the container.

9. The container of claim 1, wherein the pseudo-latent image comprises an image area formed with a colorless overcoat varnish.

10. The container of claim 1, wherein the version of the pseudo-latent image included in the encoded design is visually perceivable by a human from fewer than all viewing angles with respect to the surface of the container.

11. A container, comprising:

a recipient address field;

pre-paid postage printed on the container prior to providing the container to a sender, the postage being visually perceivable by a human from all viewing angles with respect to a surface of the container;

a multi-level security element, comprising:

a pseudo-latent image comprising a plurality of letters forming a word, the pseudo-latent image formed on the surface of the container at a first location and being visually perceivable by a human from fewer than all viewing angles with respect to the surface of the container; and an encoded design comprising a version of the pseudo-latent image comprising a misspelling of the word, the misspelling of the word being according to a verification code indicating an authenticated misspelling of the word, and the encoded design formed on the surface of the container at a second location different from the first location and being visually perceivable by a human; and a sender address field, wherein, based on the verification code, the visually perceivable encoded design is compared to the visually perceivable pseudo-latent image in order to authenticate the container.

12. The container of claim 11, wherein the pseudo-latent image comprises letters.

13. The container of claim 11, wherein the encoded design comprises letters.

14. The container of claim 11, comprising a phosphorescent taggant on the container.

15. The container of claim 14, wherein the phosphorescent taggant is located on the postage printed on the container.

16. The container of claim 11, wherein the postage printed on the container is rub resistant or fade resistant.

17. The container of claim 11, wherein the recipient address field comprises space for displaying a street address, a state, a city, a county, a delivery code, and a country of a recipient of the container.

18. The container of claim 11, wherein the sender address field comprises space for displaying a street address, a state, a city, a county, a delivery code, and a country of the sender of the container.

19. The container of claim 11, wherein the pseudo-latent image comprises an image area formed with a colorless overcoat varnish.

20. The container of claim 11, wherein the version of the pseudo-latent image included in the encoded design is visually perceivable by a human from fewer than all viewing angles with respect to the surface of the container.

21. A method for supplying a container, comprising:

printing postage on the container, the postage being visually perceivable by a human from all viewing angles with respect to a surface of the container;

producing a multi-level security element by:

forming, by applying an overcoat with a drop-off pattern, a pseudo-latent image on the surface of the container at a first location, the pseudo-latent image comprising a plurality of letters forming a word and being visually perceivable by a human from fewer than all viewing angles with respect to the surface of the container; and forming an encoded design on the surface of the container at a second location different from the first location, the encoded design comprising a version of the pseudo-latent image comprising a misspelling of the word, the misspelling of the word being according to a verification code indicating an authenticated misspelling of the word, and being visually perceivable by a human; and providing the container to a sender, wherein, based on the verification code, the visually perceivable encoded design is compared to the visually perceivable pseudo-latent image in order to authenticate the container.

22. The method of claim 21, wherein the version of the pseudo-latent image included in the encoded design is visually perceivable by a human from fewer than all viewing angles with respect to the surface of the container.

* * * * *